US007445372B1

(12) United States Patent
Engel et al.

(10) Patent No.: US 7,445,372 B1
(45) Date of Patent: Nov. 4, 2008

(54) CUSTOM COSMETIC MIXER

(75) Inventors: Steven P. Engel, Rockford, MI (US); Ronald J. Sharpe, Grand Rapids, MI (US); Daniel Donnelly, Greenville, MI (US); Mark G. Sinreich, Akron, OH (US)

(73) Assignee: Access Business Group International LLC, Ada, MI (US)

( * ) Notice: Subject to any disclaimer, the term of this patent is extended or adjusted under 35 U.S.C. 154(b) by 471 days.

(21) Appl. No.: 11/242,563

(22) Filed: Oct. 3, 2005

Related U.S. Application Data

(60) Provisional application No. 60/615,565, filed on Oct. 1, 2004.

(51) Int. Cl.
*B01F 7/00* (2006.01)
*B01F 15/02* (2006.01)

(52) U.S. Cl. ..... 366/168.1; 366/195; 222/145.6

(58) Field of Classification Search ..... 366/160.2, 366/160.3, 155.1, 158.1, 168.1, 172.2, 181.4, 366/182.2, 194, 195, 196; 222/145.6
See application file for complete search history.

(56) References Cited

U.S. PATENT DOCUMENTS

| | | | | |
|---|---|---|---|---|
| 2,159,670 | A * | 5/1939 | Neitzke | 366/196 |
| 2,660,190 | A | 11/1953 | Blondel | |
| 2,847,196 | A | 8/1958 | Franklin et al. | |
| 2,857,144 | A * | 10/1958 | Gurley, Jr. et al. | 366/295 |
| 2,925,102 | A * | 2/1960 | Cummings et al. | 141/263 |
| 3,051,455 | A * | 8/1962 | Magester | 366/172.1 |
| 3,067,987 | A | 12/1962 | Ballou et al. | |
| 3,102,717 | A * | 9/1963 | Frenkel | 366/266 |
| 3,228,662 | A | 1/1966 | Morshauser et al. | |
| 3,302,832 | A * | 2/1967 | Hardman et al. | 222/94 |
| 3,353,797 | A * | 11/1967 | Simonetti | 366/101 |
| 3,387,692 | A | 6/1968 | Levake | |
| 3,390,814 | A | 7/1968 | Creighton, Jr. et al. | |
| 3,416,517 | A | 12/1968 | Adams et al. | |
| 3,420,506 | A * | 1/1969 | Gurley, Jr. | 366/317 |
| 3,527,236 | A | 9/1970 | Anthony et al. | |

(Continued)

FOREIGN PATENT DOCUMENTS

| | | |
|---|---|---|
| EP | 0165098 | 12/1985 |

(Continued)

*Primary Examiner*—Tony G Soohoo
(74) *Attorney, Agent, or Firm*—Warner Norcross & Judd LLP

(57) ABSTRACT

A device for blending and dispensing liquid compositions includes an arrangement of components that provide an efficient dispenser for home and personal use. The device may include a plurality of cartridges and a plurality of pumps. Each of the cartridges contains a liquid additive and may be removably attached to the dispenser. Each of the pumps is connected to one of the cartridges and can be activated to draw a desired amount of liquid from that cartridge. The device may also include a spinning element for both mixing and dispensing the liquid composition. The liquids may flow out of the cartridges to one or more inlets near the surface of the spinning element and be mixed as they flow over the surface of the spinning element. The spinning element may also be selectively movable from a closed position sealing the dispensing outlet to an open position that provides a pathway for liquid to be dispensed from the device. In another embodiment, the device may include a compact housing for fitting into a small compartment, such as a purse.

8 Claims, 18 Drawing Sheets

U.S. PATENT DOCUMENTS 3,570,719 A * 3/1971 Schiff ..... 222/137
3,741,441 A * 6/1973 Eberle ..... 222/135
3,753,554 A 8/1973 Muller et al.
3,934,759 A * 1/1976 Giannella et al. ..... 222/129.1
4,140,299 A * 2/1979 Henderson et al. ..... 366/181.7
4,171,039 A 10/1979 Ingham
4,173,396 A 11/1979 Marshall
4,222,448 A 9/1980 Sunkle et al.
4,275,822 A 6/1981 Juffa et al.
4,353,867 A 10/1982 Luzzana
4,527,713 A 7/1985 Ingram
4,653,010 A 3/1987 Figler et al.
4,717,047 A * 1/1988 van Overbruggen et al. 222/207
4,719,574 A 1/1988 Duback et al.
4,747,692 A * 5/1988 Harrison ..... 366/102
4,766,913 A 8/1988 Klein
4,834,545 A * 5/1989 Inoue et al. ..... 366/138
4,871,262 A 10/1989 Krauss et al.
4,887,410 A 12/1989 Gandini
4,889,432 A * 12/1989 Patterson ..... 366/139
4,976,137 A 12/1990 Decker et al.
4,986,443 A * 1/1991 Saur et al. ..... 222/1
5,025,514 A 6/1991 Miller
5,044,520 A 9/1991 Moisan
5,163,010 A 11/1992 Klein et al.
5,286,105 A * 2/1994 Herold et al. ..... 366/162.3
5,350,234 A 9/1994 Hagen
5,368,196 A 11/1994 Hellenberg et al.
5,382,090 A * 1/1995 Cocchi ..... 366/181.6
5,445,596 A 8/1995 Grace
5,720,017 A 2/1998 Cheetam et al.
5,743,640 A * 4/1998 Crossley ..... 366/194
5,778,901 A 7/1998 Abrahamian
5,780,018 A 7/1998 Collins et al.
5,799,832 A 9/1998 Mayo
5,801,951 A 9/1998 Burns, II et al.
5,862,947 A 1/1999 Wiegner et al.
5,875,930 A 3/1999 Nakajima et al.
5,903,465 A 5/1999 Brown
5,974,345 A 10/1999 Buck et al.
6,000,407 A 12/1999 Galazin
6,021,362 A 2/2000 Maggard et al.
6,067,996 A 5/2000 Weber et al.
6,129,244 A * 10/2000 Horth ..... 222/94
6,286,517 B1 9/2001 Weber et al.
6,293,693 B1 9/2001 Rodgers et al.
6,402,364 B1 6/2002 Esclar et al.
6,412,658 B1 7/2002 Bartholomew et al.
D461,080 S 8/2002 Bartholomew et al.
6,437,866 B1 8/2002 Flynn
D465,810 S 11/2002 Bartholomew et al.
6,510,366 B1 1/2003 Murray et al.
6,516,245 B1 2/2003 Dirksing et al.
6,523,992 B1 * 2/2003 Bublewitz et al. ..... 366/172.1
6,540,395 B2 * 4/2003 Muhlbauer et al. ..... 366/307
6,615,881 B2 9/2003 Bartholomew et al.
6,622,064 B2 9/2003 Bartholomew et al.
D485,310 S 1/2004 Bartholomew et al.
6,672,341 B2 1/2004 Bartholomew et al.
6,817,749 B2 * 11/2004 Saunders et al. ..... 366/76.7
6,932,243 B2 * 8/2005 Keller ..... 222/145.6
2002/0010528 A1 1/2002 Bartholomew et al.
2002/0082745 A1 6/2002 Wilmott et al.
2002/0194021 A1 12/2002 Matsumoto et al.
2003/0062385 A1 4/2003 Engel et al.

FOREIGN PATENT DOCUMENTS

GB 2145694 4/1985
JP 3056165 3/1991
JP 4215995 8/1992
JP 07282334 10/1995
JP 11147811 6/1999
WO WO 9505891 3/1995

* cited by examiner

CUSTOM COSMETIC MIXER

This application claims the benefit of U.S. Provisional Patent Application Ser. No. 60/615,565, filed Oct. 1, 2004, which is hereby incorporated by reference.

BACKGROUND OF THE INVENTION

The present invention relates to a device for blending and dispensing liquid compositions, and more particularly to a personal use machine for blending and dispensing liquid compositions including, among other products, liquid cosmetic compositions.

There are a number of well known devices for blending and dispensing liquid compositions. Most of these devices are intended for use in a retail setting, where consumers go to purchase the custom cosmetics. These devices allow consumers to customize products such as cosmetics in order to meet their individual needs and desires. For instance, a consumer can input data for a particular skin tone into the device, and then activate the device to mix and dispense a cosmetic product that corresponds to their particular skin tone.

Common dispensing devices include a number of interacting components, such as a user interface for input of the desired liquid composition; a container that stores one or more liquid compositions; a pump to transport appropriate amounts of the liquids from the container; a mixing system to blend the liquids; and a container to hold the dispensed liquid. Manufacturers are continually trying to develop new components or new combinations of components in order to provide a more efficient and user friendly dispensing device.

SUMMARY OF THE INVENTION

The aforementioned problems are overcome by the present invention wherein a device for blending and dispensing liquid compositions includes an arrangement of components that provide an efficient device for home and personal use.

In one embodiment, the device includes a plurality of cartridges and a plurality of pumps. Each of the cartridges contains a liquid additive and is removably attached to the dispenser. Each of the pumps is connected to one of the cartridges and can be activated to draw a desired amount of liquid from that cartridge. The pumps may each include an input tube that terminates in a needle, and the cartridges may be sealed with a penetrable foam. The liquid in each cartridge is accessed by the pump by piercing the foam with the needle.

In another embodiment, the device may include a spinning element for both mixing and dispensing the liquid composition. The spinning element is disposed in the flow path of the liquids. The various liquids flow out of the cartridges to one or more inlets near the surface of the spinning element and are mixed as they flow over the surface of the spinning element. The spinning element may be connected to a motor for actuating rotation of the spinning element. The spinning element may also be movable to selectively close the outlet of the mixer. In one embodiment, the spinning element may be movable from a closed position sealing the mixer outlet, to an open position that creates a pathway for liquid to be dispensed from the device. In another embodiment, the spinning element may be a spinning cone that directs the liquids towards an outlet.

In yet another embodiment, the device includes a compact housing for fitting into a small compartment, such as a purse. The dispensed liquid flows from the device into a small container, such as a compact, that may be sealed and removed from the dispensing device for carrying the custom composition.

The present invention provides an efficient way to mix and dispense custom liquid compositions. For instance, the spinning element provides a way to mix liquids as the liquids flow towards an outlet, without the need for a separate mixing chamber. The selective movement of the spinning element provides a way to direct the liquids towards the outlet and for sealing the outlet after a desired amount of liquid has been dispensed. The size of the housing and container provides the device with portability, and facilitates at home, personal use.

These and other objects, advantages, and features of the invention will be more fully understood and appreciated by reference to the detailed description of the current embodiments and the drawings.

DETAILED DESCRIPTION OF THE CURRENT EMBODIMENTS

I. Overview

Figure 1:
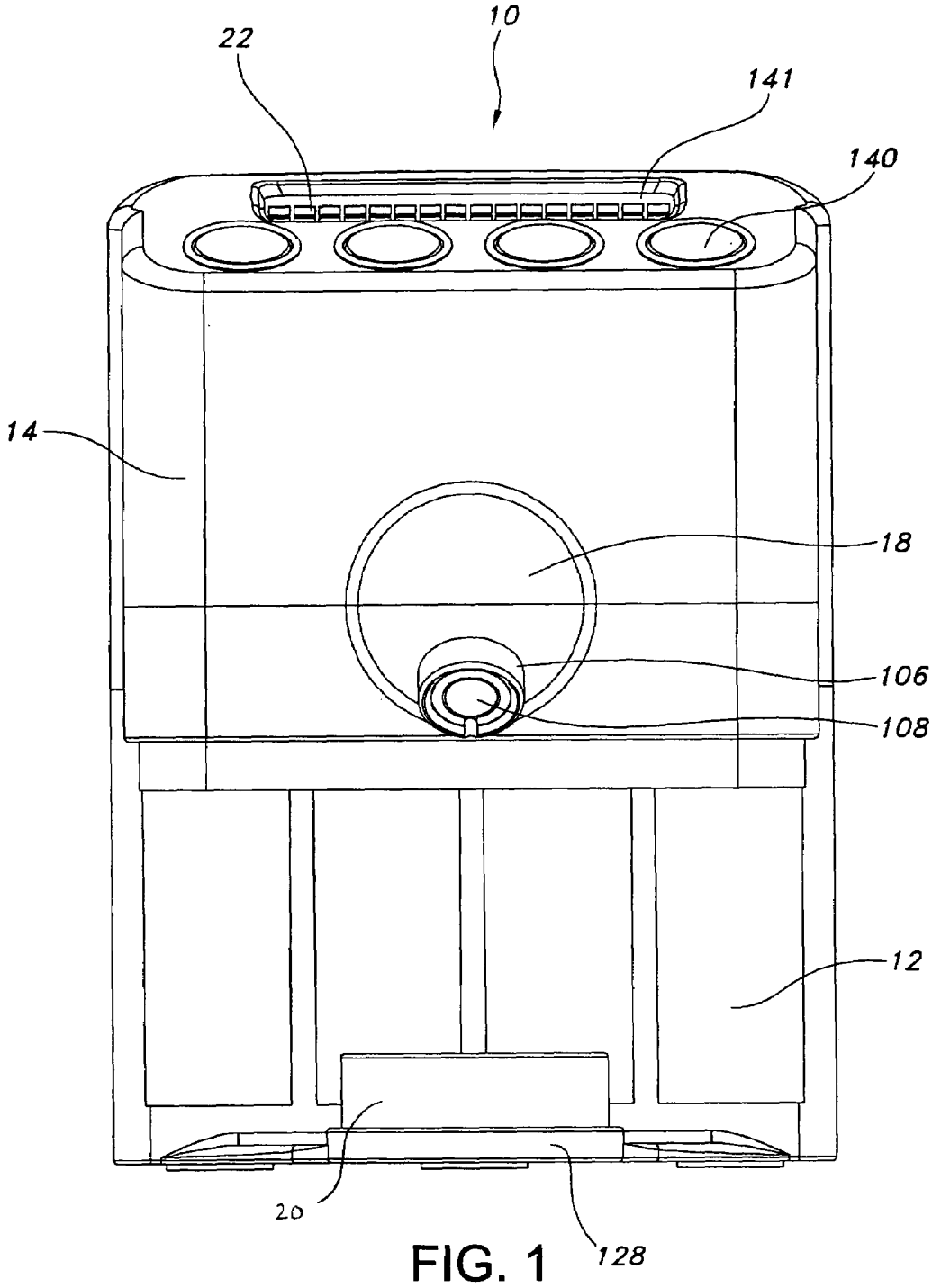
FIG. 1 is a front view of the device in accordance with a first embodiment of the present invention.

A device for blending and dispensing custom liquid compositions is shown in FIG. 1 and generally designated 10. The device 10 may include one or more cartridges 12 for containing liquid additives (not shown), a housing 14 for receiving attachment from the cartridges 12 and for containing a pumping system 16, a dispensing system 18 for mixing and dispensing a liquid composition into a container 20, and a control system 22 for receiving input data and metering the correct amounts of each liquid additive to correspond with the input data. In operation, a user may input data into the device corresponding to a particular liquid composition, and then actuate the device to mix and dispense that particular liquid composition.

The device 10 may be used in connection with a variety of known liquid additives that can be blended together to form a custom composition. For example, the custom compositions formed may include, inter alia, cosmetics, vitamins, minerals, sunscreens, lotions, creams, fragrances, and household cleaners.

II. Structure

Figure 4:
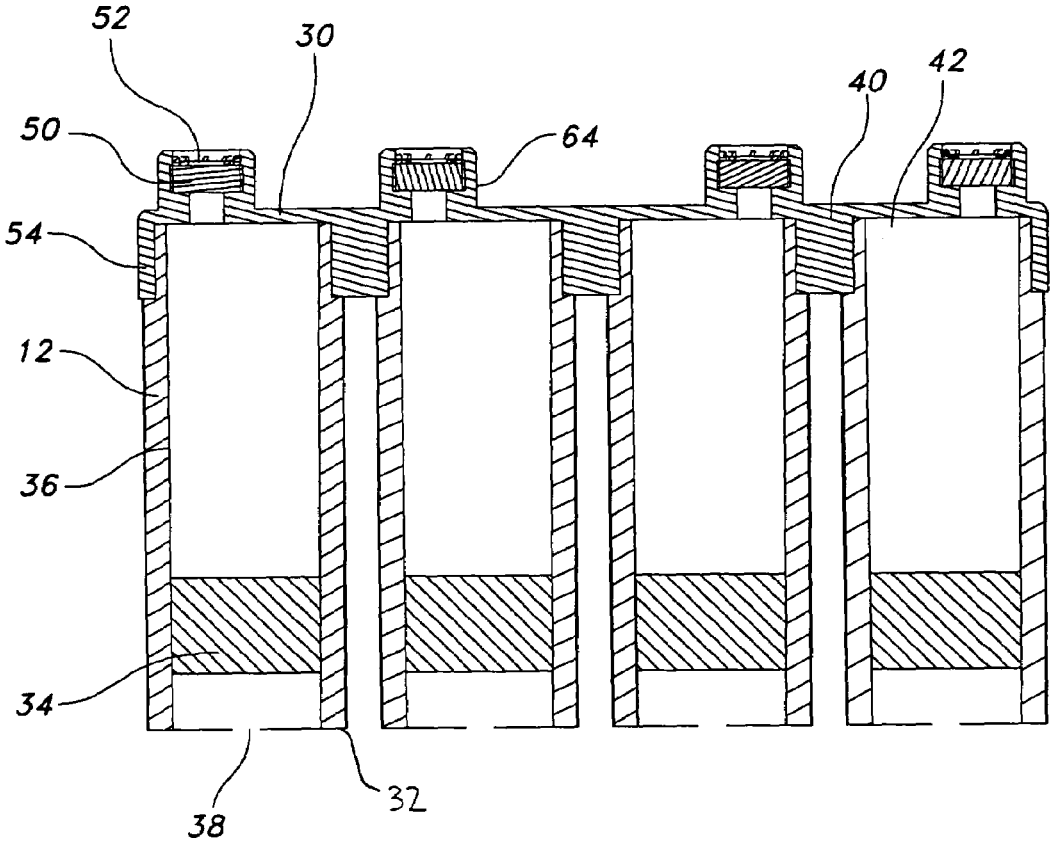
FIG. 4 is a cross sectional view of the cartridges.
Figure 5:
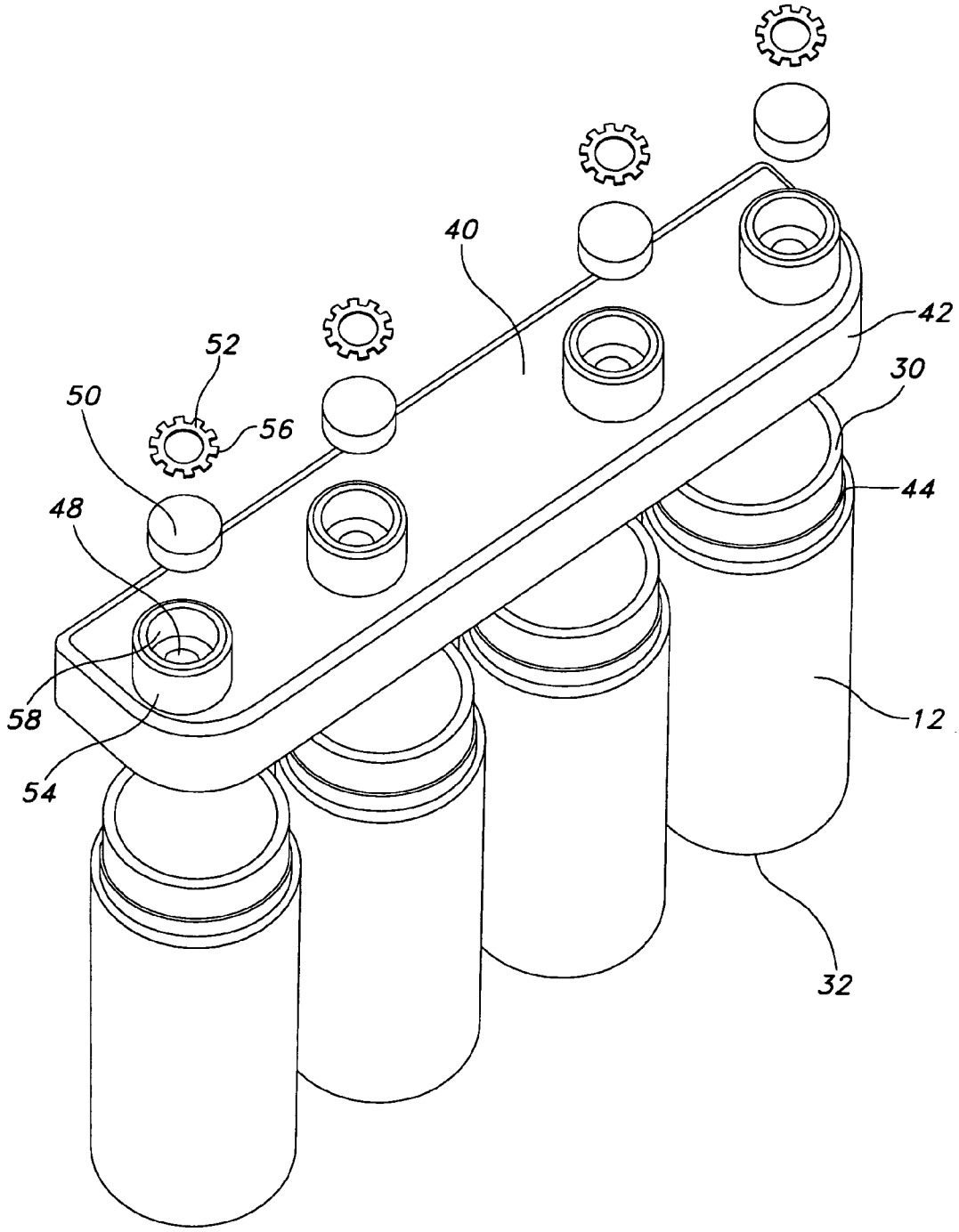
FIG. 5 is an exploded view of the cartridges.
Figure 6:
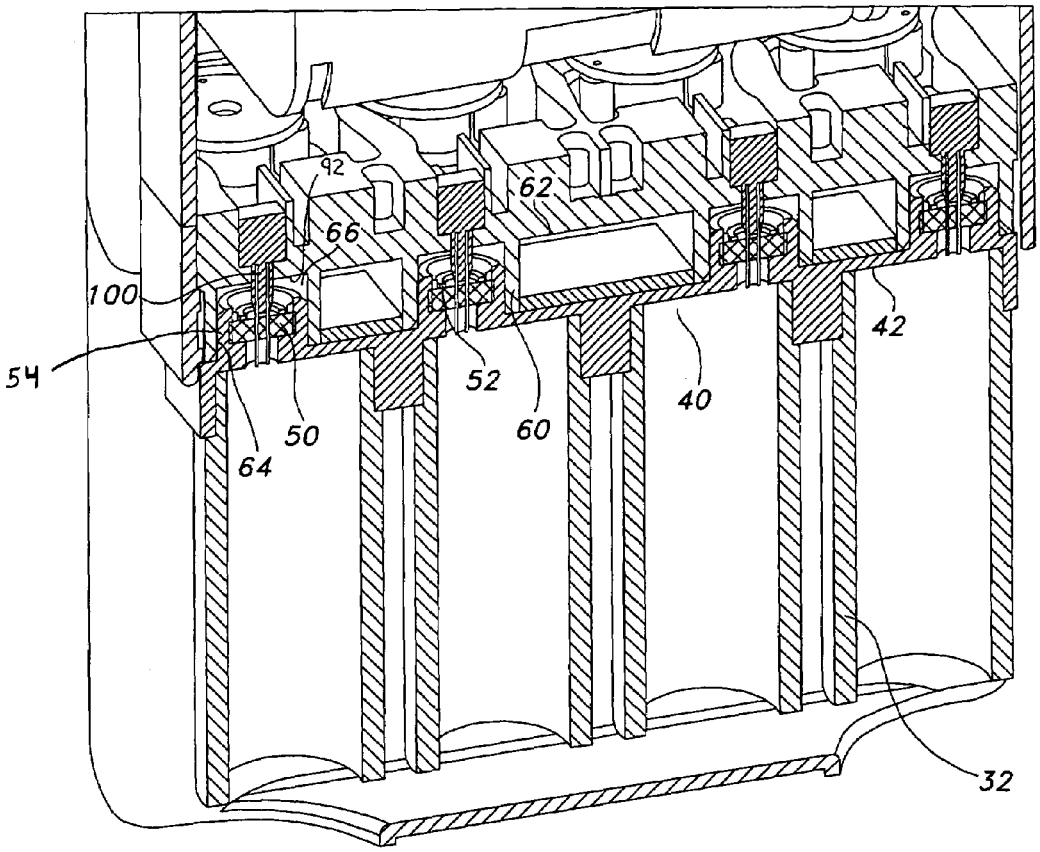
FIG. 6 is a cross sectional view of the cartridges and pumps.

The cartridges 12 are containers for holding liquid additives. In the illustrated embodiment, the cartridges 12 are cylindrical containers having an open top end 30 and a closed bottom end 32. The cartridges 12 may be self-priming, for instance, by a piston 34 as shown in FIG. 4. In this embodiment, the piston 34 is disposed inside the cartridge 12 forming an airtight seal against the inner wall 36 of the cartridge 12. The bottom end 32 of the cartridge 12 defines an air hole 38, allowing atmospheric pressure to draw the piston 34 towards the top end 30 of the cartridge 12 as the liquid additive is drawn out of the cartridge 12. As shown in FIGS. 5 and 6, a plurality of cartridges 12 may be attached to a plate 40 for easy attachment to the dispensing device 10. The open top ends 30 of each cartridge 12 attach to a lower edge 42 of the plate 40 by a conventional method, such as by threads 44 on the outer edge 46 of each cartridge 12 that screw into threads (not shown) on the lower edge 42 of the plate 40. The plate 40 contains a plurality of orifices 48 that provide an exit for the liquid additives from the cartridges 12. The orifices 48 may be sealed to prevent liquid from exiting the cartridges 12 until the cartridges 12 are attached to the dispensing device 10. As shown, the orifices 48 are sealed by foam inserts 50 that are disposed in receptacles 54 positioned above each orifice 48. The foam inserts 50 may be held in the receptacles by O-rings 52 that fit inside the receptacles 54 above the foam inserts 50 and have outwardly projecting fingers 56 that press against the inner wall 58 of the receptacle 54 to frictionally hold the O-ring 52 and the foam 50 in the receptacle 54. Alternatively, the orifices 48 may be sealed by a ball and spring apparatus (not shown). In this embodiment, a ball is disposed within the orifice 48 to seal the orifice 48. The ball is supported by a spring, such that when force is applied to the ball it pushes against the spring and creates an opening in the orifice 48.

The cartridges 12 may removably attach to the dispensing device 10 by a variety of conventional attachment methods. One such method is shown in FIG. 6, wherein each receptacle 54 is snap-fitted into a downwardly extending U-shaped flange 60. The flanges 60 may extend from a lower surface 62 of the pumping system 16 (described in detail below), or from another surface on the dispensing device 10. As shown, the outer wall 64 of each receptacle 54 is frictionally fitted within the inner wall 66 of one of the U-shaped flanges 60. In this arrangement, the cartridges 12 may all be removed together by removing the plate 40 from the flanges 60, and additionally the cartridges 12 may be individually removable by unscrewing a desired cartridge 12 from the plate 40.

Figure 2:
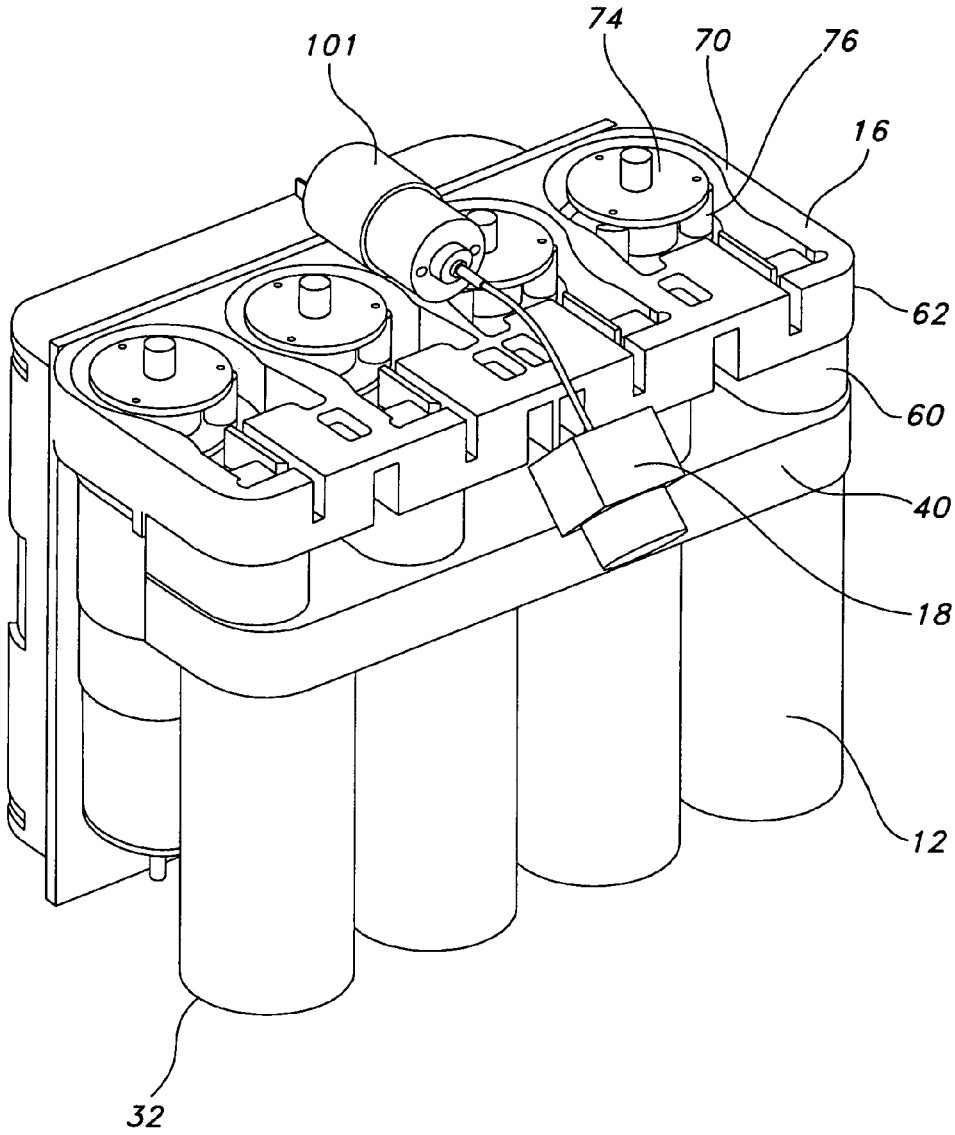
FIG. 2 is a perspective view of the device of the first embodiment with the housing removed.
Figure 3:
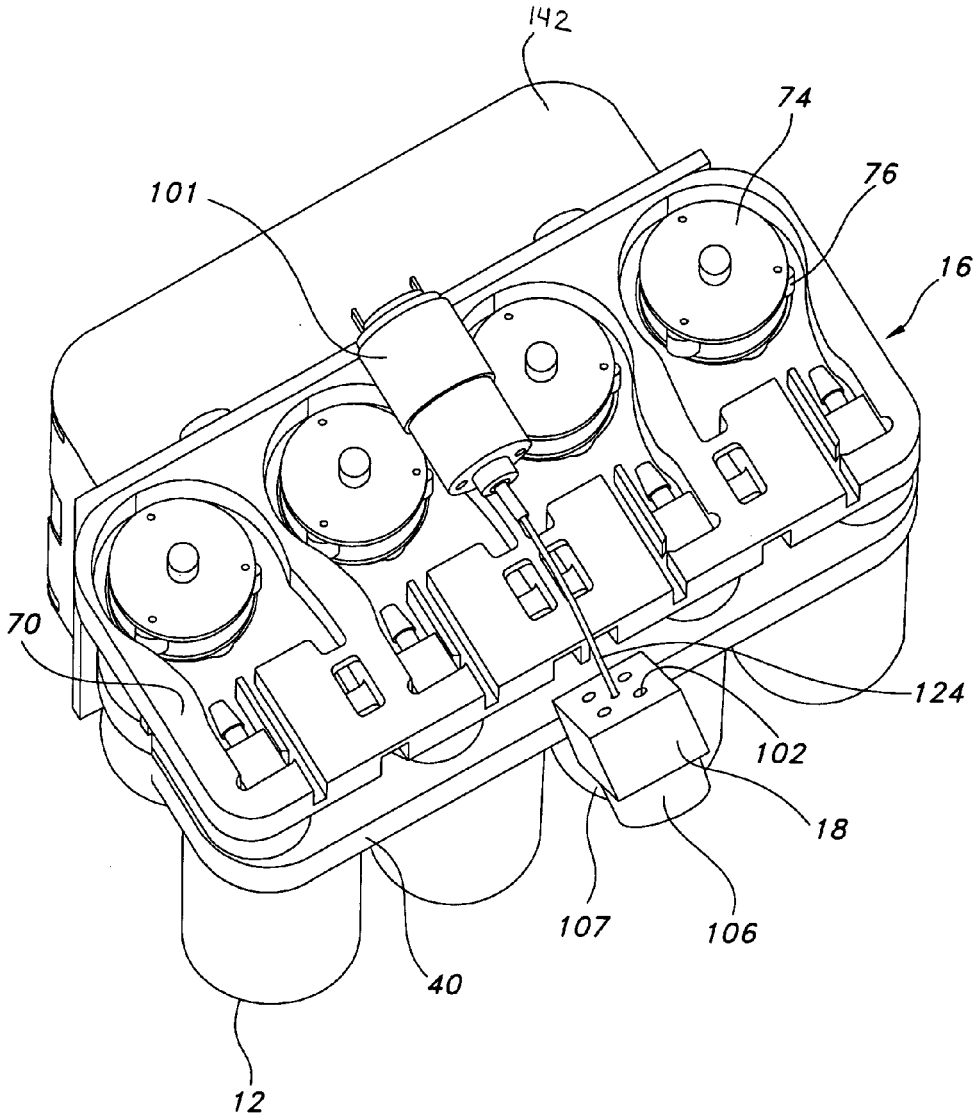
FIG. 3 is a top view of the device of the first embodiment with the housing removed.
Figure 7:
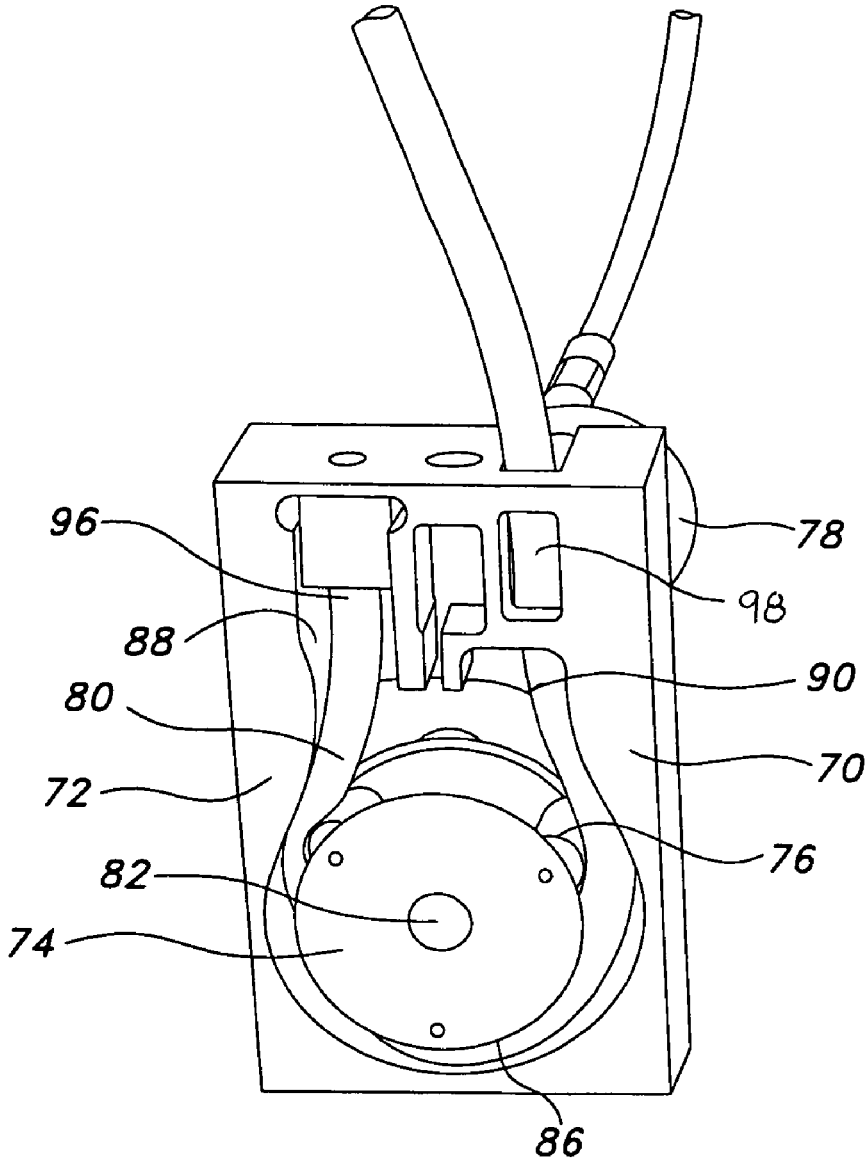
FIG. 7 is a perspective view of a peristaltic pump.
Figure 8:
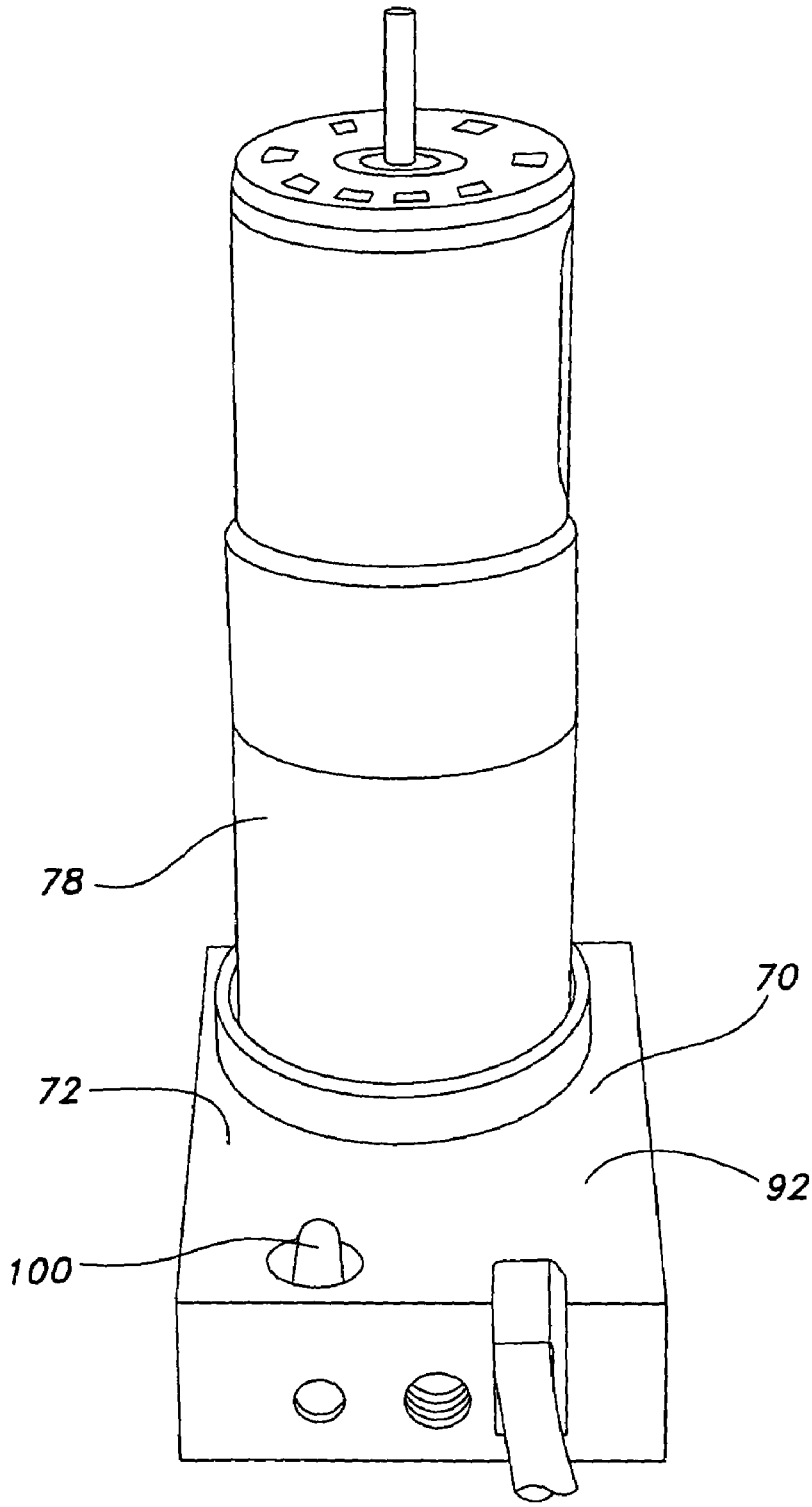
FIG. 8 is a side view of a peristaltic pump.

The device 10 further includes a pumping system 16 for drawing the liquid additives out of the cartridges 12. The pumping system 16 may be comprised of one or more of a variety of pumps, which are generally mounted within the housing 14 by a conventional method. FIGS. 2, 3, and 6 show one embodiment of the device 10, wherein the pumping system 16 is a plurality of peristaltic pumps 70. An example of a peristaltic pump 70 is shown in FIGS. 7 and 8. Peristaltic pumps are generally conventional, and as shown they generally include a block 72, a rotating element 74 including a plurality of rollers 76, a motor 78 for rotating the element 74, and a flexible tube 80 extending through the block 72 such that it passes around the rotating element 74 and the rollers 76. As shown, the rotating element 74 is a disc that rotates about an axis 82 and includes an outer edge 86 that holds three circumferentially spaced rollers 76. The block 72 includes a channel 88 for receiving the tube 80 and guiding the tube 80 about the rotating element 74 with the outer edge 90 of the tube 80 engaging each of the rollers 76. The motor 78 attaches to a bottom surface 92 of the block 72 and includes a drive shaft (not shown) that extends through the rotating element 74 and can be actuated to rotate the element 74. The tube 80 includes a first end 96 and a second end 98. The first end 96 is attached to one of the cartridges 12. In one embodiment, the first end 96 terminates in a needle 100. As shown in FIG. 6, the needle 100 extends through the bottom surface 92 of the block 72, and into the U-shaped flange 60 such that it pierces the foam insert 50 of one of the cartridges 12 and extends into the cartridge 12 when the cartridges 12 are attached to the device 10. The second end 98, or exit end, is connected to the dispensing system 18 (described in detail below). Alternatively, the first end 96 may include another element for connecting to the cartridges 12, for instance, in the ball and spring embodiment described above, the first end 96 may have a portion or a protrusion that engages the ball to push the ball and open the orifice 48.

Figure 9:
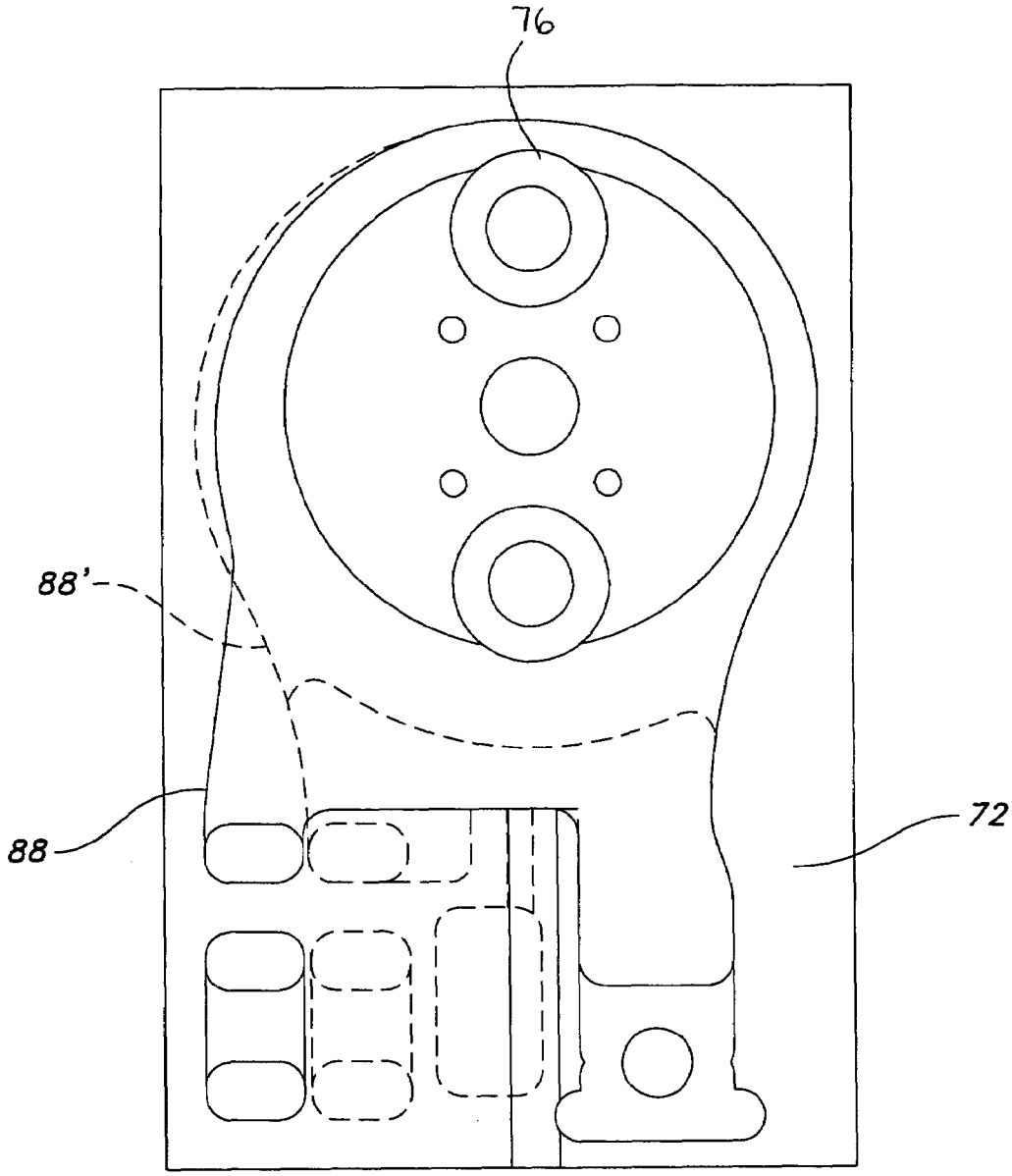
FIG. 9 is a front view showing two embodiments of the block of a peristaltic pump.

In one embodiment, the peristaltic pumps 70 may be designed to alleviate the pulsating liquid flow commonly caused by the impact of the rollers 76 on the tubes 80. As shown in FIG. 9, in this embodiment the channel 88 that guides the tube 80 through the block 72 is configured so that the tube 80 tapers away from the rotating element 74 as it approaches the second end 98. As illustrated, the tube 80 begins to taper away from the rotating element through approximately the last 120 degrees of rotation of the rotating element 74. The tapering of the tube 80 allows the rollers 76 to gradually disengage the tube 80, instead of the abrupt disengagement common to conventional peristaltic pumps. FIG. 9 shows the difference between the conventional channel 88', shown in broken lines, and the reconfigured channel 88, shown in solid lines.

Figure 16:
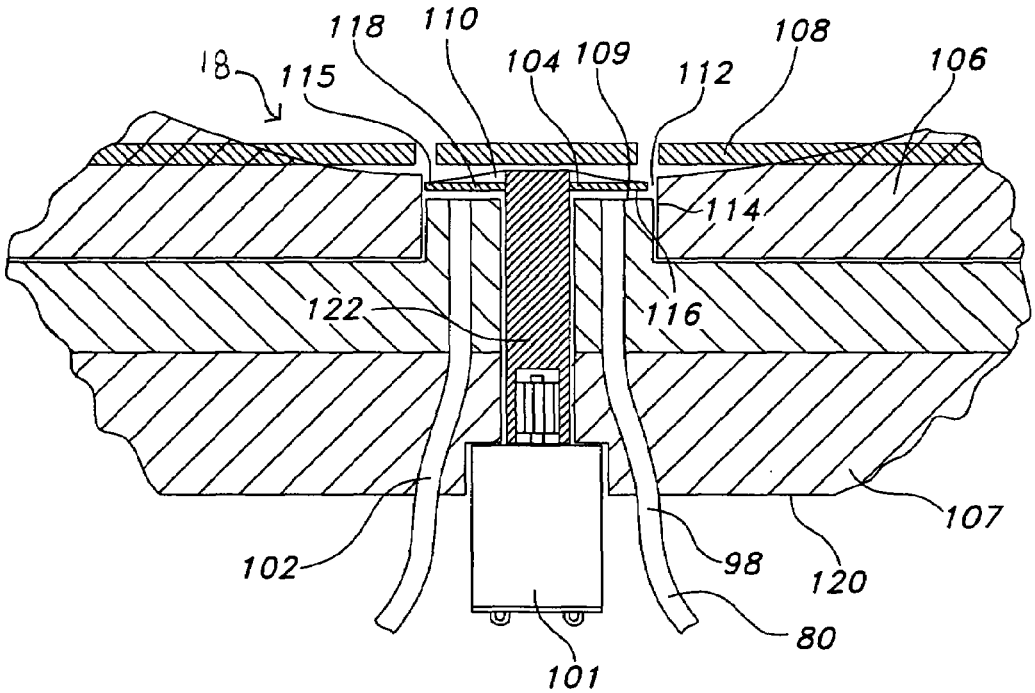
FIG. 16 is a cross sectional view of the first embodiment of the dispensing system.
Figure 17:
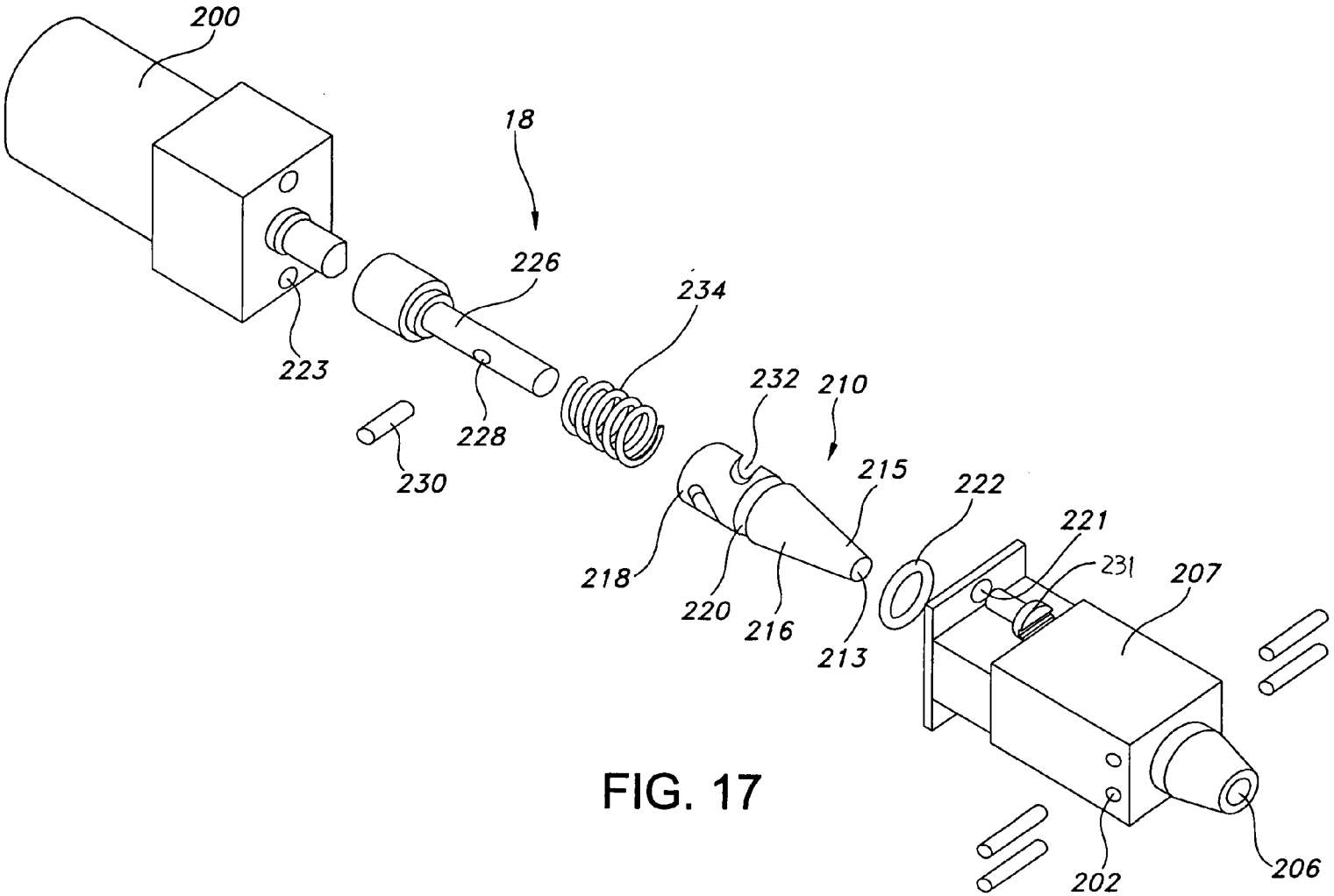
FIG. 17 is an exploded view of a second embodiment of the dispensing system.
Figure 18:
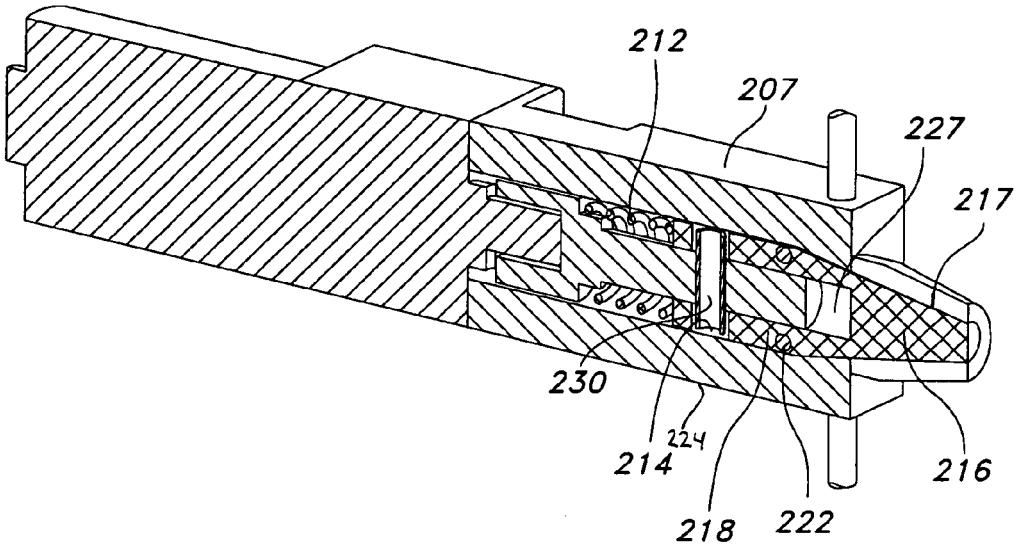
FIG. 18 is a cross sectional view of the second embodiment of the dispensing system.
Figure 19:
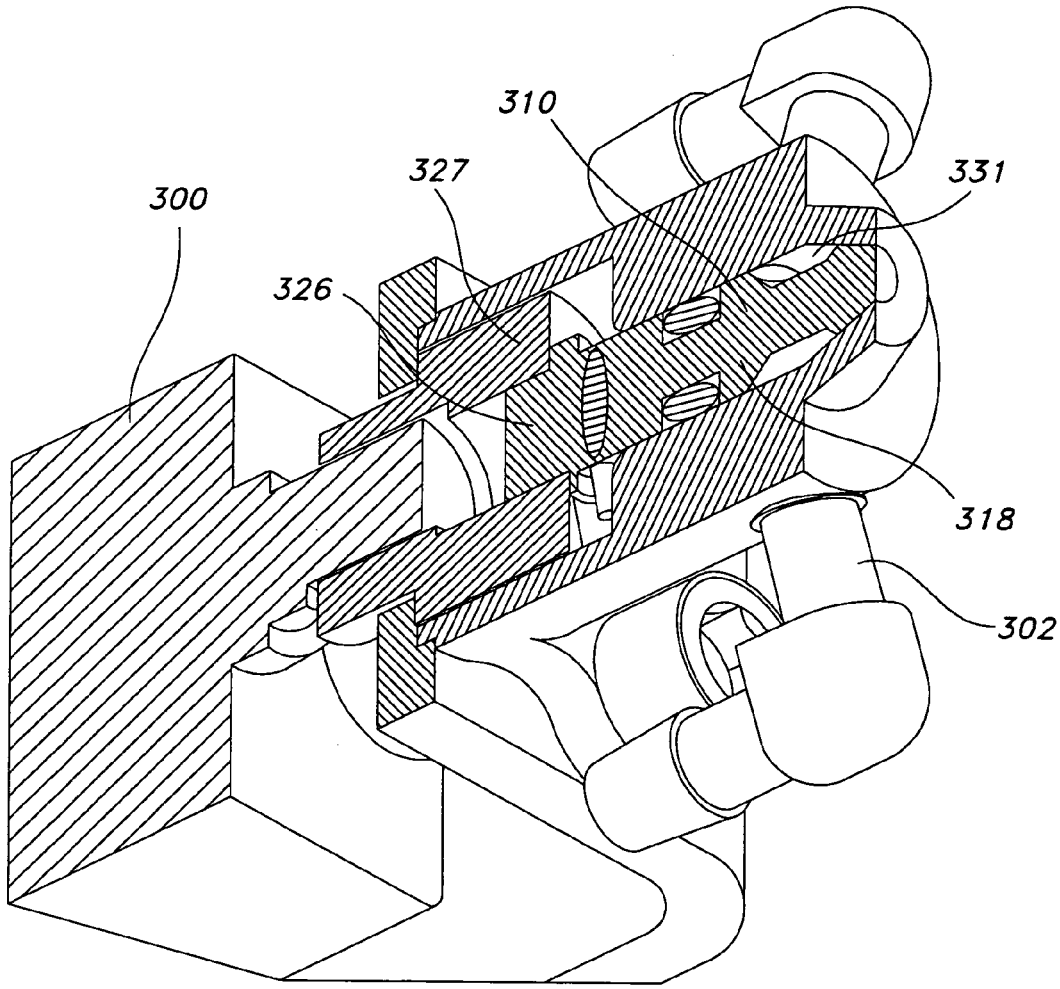
FIG. 19 is a cross sectional view of an alternative of the second embodiment of the dispensing system.

Referring now to FIG. 16, the dispensing system 18 may include a motor 101, a plurality of inlets 102, a spinning element 104, a nozzle 106, a mixing head 107, and a cover 108. In general, the exit ends 98 of the tubes 80 connect each respective pump of the pumping system 16 to one of the inlets 102 of the dispensing system 18, allowing liquid additives to flow out of the pumping system 16 and into the inlets 102 of the dispensing system 18. As shown, the dispensing system 18 includes four inlets 102, one for each of the pumps 70 of the pumping system 16. The liquid entering the dispensing system is directed inside a mixing head 107 and onto the spinning element 104 located within the mixing head 107.

Figure 15:
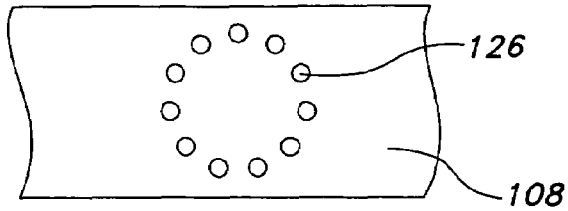
FIG. 15 is a top view of the cover of a first embodiment of the dispensing system.

As shown in FIGS. 1-3, 15 and 16, in one embodiment the spinning element 104 is a spinning disc 110. The spinning disc 110 is positioned inside the nozzle 106, between the cover 108 and a plate 109 attached inside the mixing head 107. The disc 110 is sized so that there is a small gap 112 between the inner wall 114 of the nozzle 106 and the outer edge 115 of the disc 110. The disc 110 includes a first side 116 facing the plate 109, and a second side 118 facing the cover 108. The inlets 102 are holes cut into the mixing head 107 that extend from a rear side 120 of the mixing head 107 through the plate 109. The inlets 102 may receive the tubes 80 that are connected to the pumping system 16 so that the liquid in each tube 80 can pass through a corresponding inlet 102 until it contacts the first side 116 of the spinning disc 110. The disc 110 is attached to the motor 101 by a drive shaft 122. As illustrated in FIGS. 2 and 3, the drive shaft may be a conventional flex cable 124 extending between the motor 101 and the disc 110. The motor 101 can be actuated to spin the disc 110. The cover 108 is attached to the mixing head 107 and positioned inside the nozzle 106 over the disc 110. As shown in FIG. 15, the cover 108 may include a number of exit holes 126. In one embodiment (not shown), the disc 110 may be biased against the plate 109 with a spring (not shown), and may be movable from a closed position against the plate 109 to an open position (as shown) by the force of liquid as it exits the inlets 102 and presses against the first side 116 of the disc 110. As shown in FIGS. 1-3, the nozzle 106 faces the container 20. The container 20 is generally of a compact size, and may be cylindrical (as shown), or a wide variety of other sizes and shapes. The container 20 may be removably mounted to a receptacle 128 attached to the housing 12, for instance, by a friction fit between the outer surface 130 of the container and a rim 132 on the receptacle 128, or by another known attachment method. In addition, the container 20 may include a cap (not shown) for sealing the dispensed custom composition in the container 20. The cap may be any conventional style of cap or lid, such as a screw-on cap.

The device 10 also includes a control system 22. As shown in FIGS. 1-3, the control system 22 may include a plurality of input buttons 140, and a graphical user interface, such as an LED or LCD display 141. Alternatively, a variety of other control systems may be used to receive and process data entered by a user. The control system 22 further includes a controller (not shown) for processing data received from the buttons 140 and sending outputs through conventional wiring (not shown) to the pumping system 16 and the dispenser motor 101 for actuating the pumping system 16 and dispensing system 18. Power to the control system 22 may be supplied by a battery pack 142 conventionally mounted inside the housing 14, for example, to the pumps 70.

III. Operation

In the operation of the embodiment described above, a number of desired liquid additives are disposed in the cartridges 12, and each cartridge 12 is attached to the plate 40 by screwing the cartridges 12 into the plate 40. The plate 40 is then attached to the pumping system 16 by snap fitting the receptacles 54 on the plate 40 into the downwardly extending flanges 60 on the pumping system 16, or by another conventional attachment method. As the plate 40 is attached to the pumping system 16, the needles 100 on the first end 96 of the tube 80 penetrate through the foam inserts 50 in the cartridge orifices 48 to access the liquid additive inside the cartridges 12.

A user may choose a desired cosmetic composition by entering data corresponding to that composition in to the control system 22, for instance, by pressing a particular sequence on the buttons 140 and following instructions on the display 141. After inputting the correct information, the controller actuates one or more of the pump motors 78 for a period of time in order to start the pumps 70 and draw the necessary amount of liquid from each cartridge 12. The pumps 70 may be actuated at different speeds, with the rate of speed of each pump 70 corresponding to the amount of that liquid required for the custom composition. The controller also actuates the motor 101 of the dispensing system 22 to start the spinning of spinning element 110.

Activation of the pumps 70 begins rotation of the rotating element 74 and the rollers 76 attached to the rotating element 74. As the rollers 76 move, they engage the tube 80 that is channeled around the rotating element 74. This engagement creates a pressure differential inside the tube 80, which draws liquid additive up through the needles 100 inside the cartridges 12 and through the first ends 96 of the tubes 80. The liquid additives travel through the tubes 80 until they pass out the second ends 98 and through the inlets 102 of the dispensing system 18.

As the liquid additives pass through the inlets 102, they are disposed on the first side 116 of the disc 110. As mentioned above, the motor 101 attached to the disc 110 is connected to the control system 22, and may either be running as the additives reach the first side 116 of the disc 110, or may be signaled to start as the additives reach the first side 116 of the disc 110. In either case, the disc 110 spins while the additives are in contact with the first side 116 of the disc 110. This spinning motion causes all of the additives to blend together on the first side 116 of the disc 110. At the same time, the additives are pushed towards the outer edge 115 of the disc 110 until they reach the gap 112 between the inner wall 114 of the nozzle 106 and the outer edge 115 of the disc 110. The mixed additives pass through the gap 112, and then pass through the exit holes 126 in the cover 108, whereby the blended additives fall into the container 20 positioned below the nozzle 106. Any desired amount of liquid can be dispensed from the device 10 into the container 20, at which point the container 20 may be removed from the device 10 and may be sealed.

IV. Alternative Embodiments

A. Alternative Pumping Systems

Figure 10:
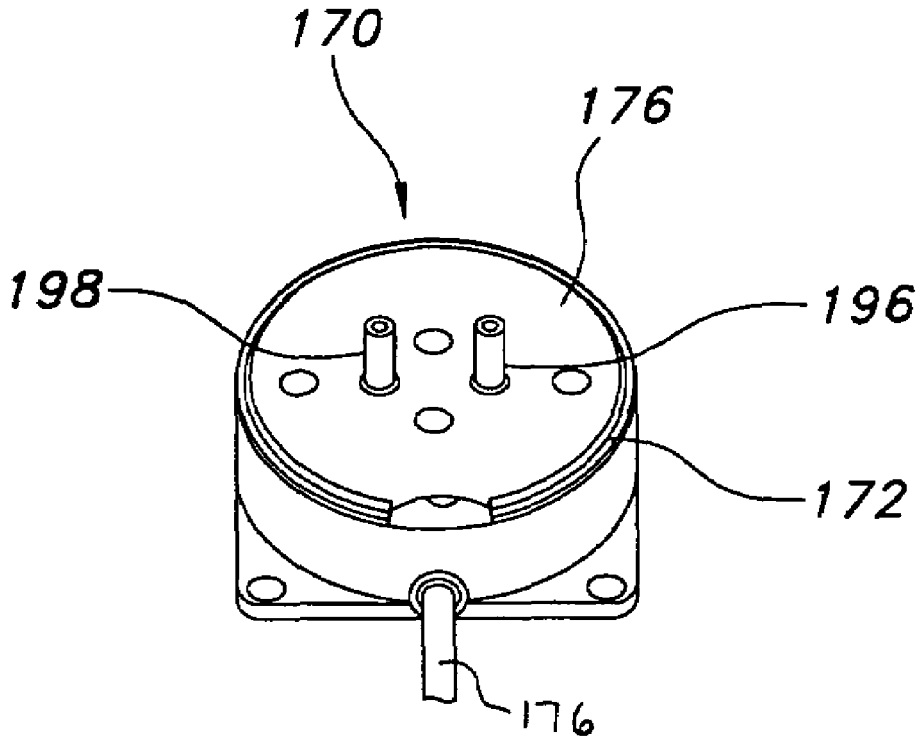
FIG. 10 is a perspective view of a piezo-electric diaphragm pump.
Figure 11:
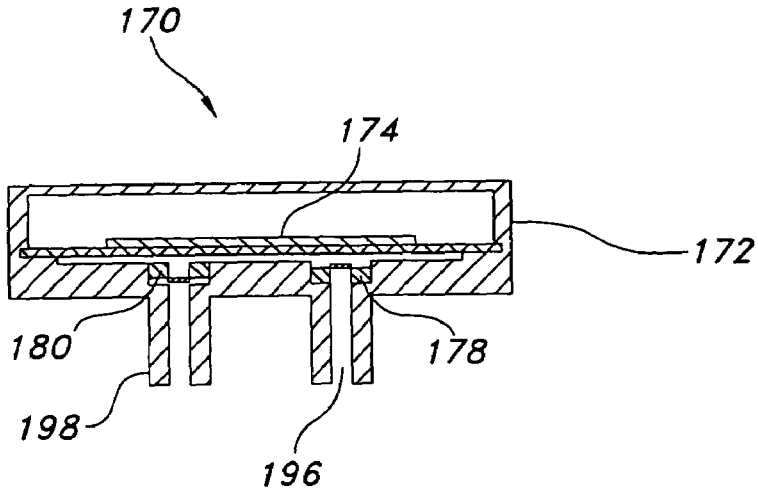
FIG. 11 is a cross sectional view of a piezo-electric diaphragm pump.
Figure 12:
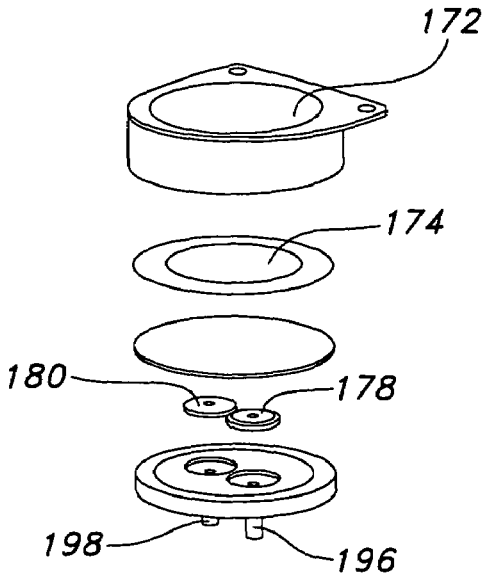
FIG. 12 is an exploded view of a piezo-electric diaphragm pump.

In another embodiment, the pumping system 16 may include a plurality of piezo-electric diaphragm pumps 170 in place of some or all of the peristaltic pumps 70. An example of this type of pump is shown in FIGS. 10-12. The piezo pump 170 includes a pump housing 172 that could be mounted inside the housing 14 the same way that the peristaltic pumps 70 are mounted. The pump 170 further includes an inlet tube 196 and an outlet tube 198 that may be connected to the cartridges 12 and dispensing system 18 in the same manner as the first and second ends 96, 98 of the peristaltic pump tube 80. As shown in FIG. 12, the piezo pump 170 operates by a piezo plate 174 mounted inside the pump housing 172. The plate 174 is comprised of a material, such as ceramic, that changes density upon receiving a voltage. In this way, the plate 174 fluctuates up and down inside the housing 172 when a voltage is applied to the plate. When the plate 174 moves up, it creates a pressure difference under the plate 174 that opens an inlet valve 178 and draws liquid from the cartridge 12 into the housing 172. When the plate 174 moves down, it opens an exit valve 180 and forces the liquid out through the exit tube 198 towards the dispensing system 18, starting the next pump cycle. Operation of the piezo pumps 170 is similar to the peristaltic pumps 70, except that no motor is necessary. These pumps 170 are connected to the control system 22, for instance by conventional wires 176, which control the electric current flowing to the pumps 170.

Figure 13:
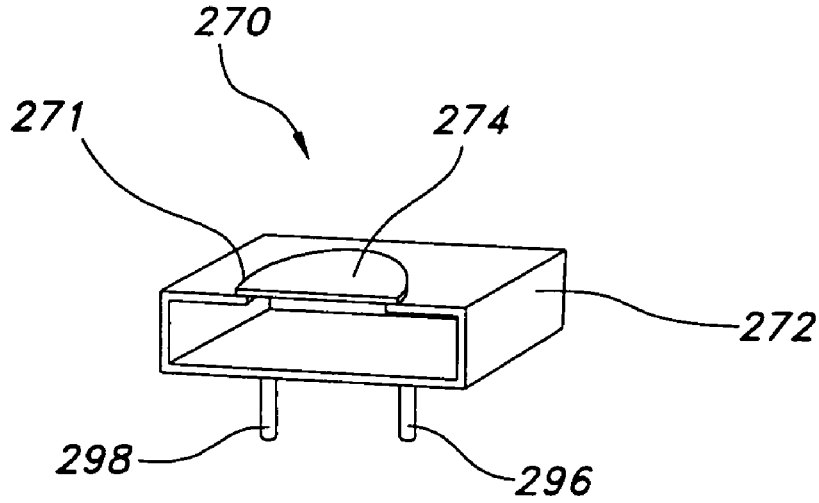
FIG. 13 is a perspective view of an EAP pump with a portion of the housing cut away.
Figure 14:
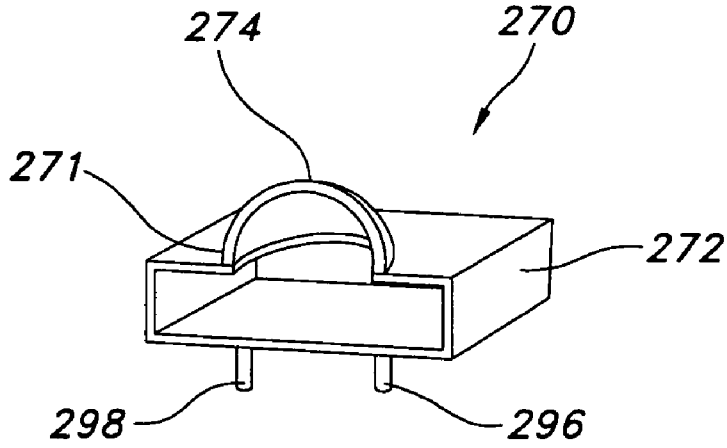
FIG. 14 is a perspective view of an EAP pump in the displaced position with a portion of the housing cut away.

In yet another embodiment, the pumping system 16 may be comprised of one or more electroactive polymer (EAP) pumps 270. These pumps 270 may have a similar configuration as the piezo pumps 170 described above, and may therefore be disposed inside the housing 14 of the dispensing device and connected to the cartridges 12 and dispensing system 18 in a similar manner. An example of an EAP pump 270 is shown in FIGS. 13 and 14. As shown, the EAP pump 270 is a diaphragm pump similar to the piezo pump 170. In this embodiment, however, the fluctuating motion is provided by a dielectric elastomer film 274 that is stretched over an opening 271 in a rigid pump housing 272. When an electric current is applied to the film 274, it moves from a relaxed position shown in FIG. 13 to the displaced position shown in FIG. 14 and creates a pressure difference that draws liquid into the housing 272. The pump 270 may include first and second tubes 296 and 298, and corresponding valves (not shown) for transporting the liquid into and out of the pump 270.

In another embodiment, the device may not have pumps for drawing the liquid additives from the cartridges. Instead, the cartridges may be pressurized and may include valves for metering the amount of liquid exiting the cartridge. The valves may be connected to the control system, which can control how long to open and close the valves corresponding to each particular liquid additive. When a valve attached to one of the cartridges is opened, the pressure inside that cartridge forces the liquid additive out of that cartridge, through the valve, and into an exit tube similar to the above described embodiments.

B. Alternative Dispensing Systems

Figure 20:
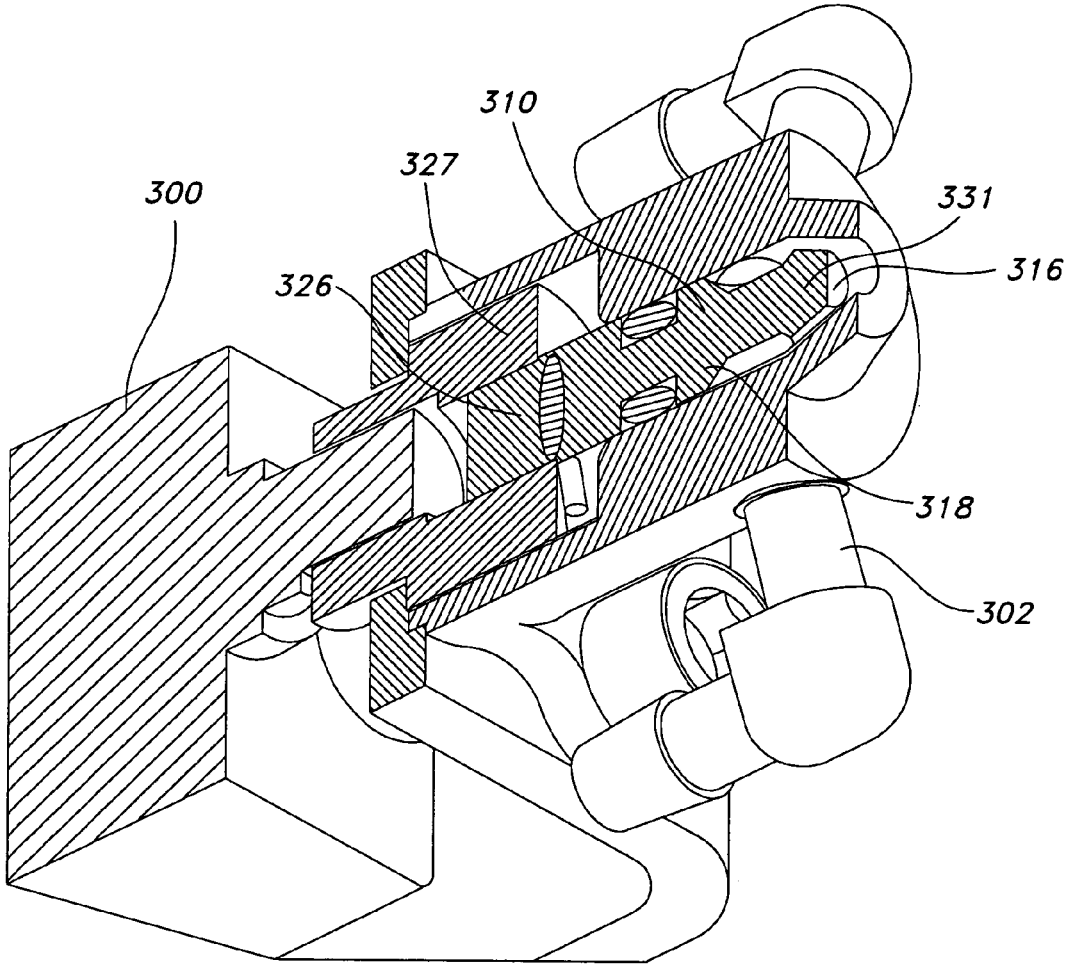
FIG. 20 is a cross sectional view of the alternative of FIG. 19 in an open position.
Figures 21, 22:
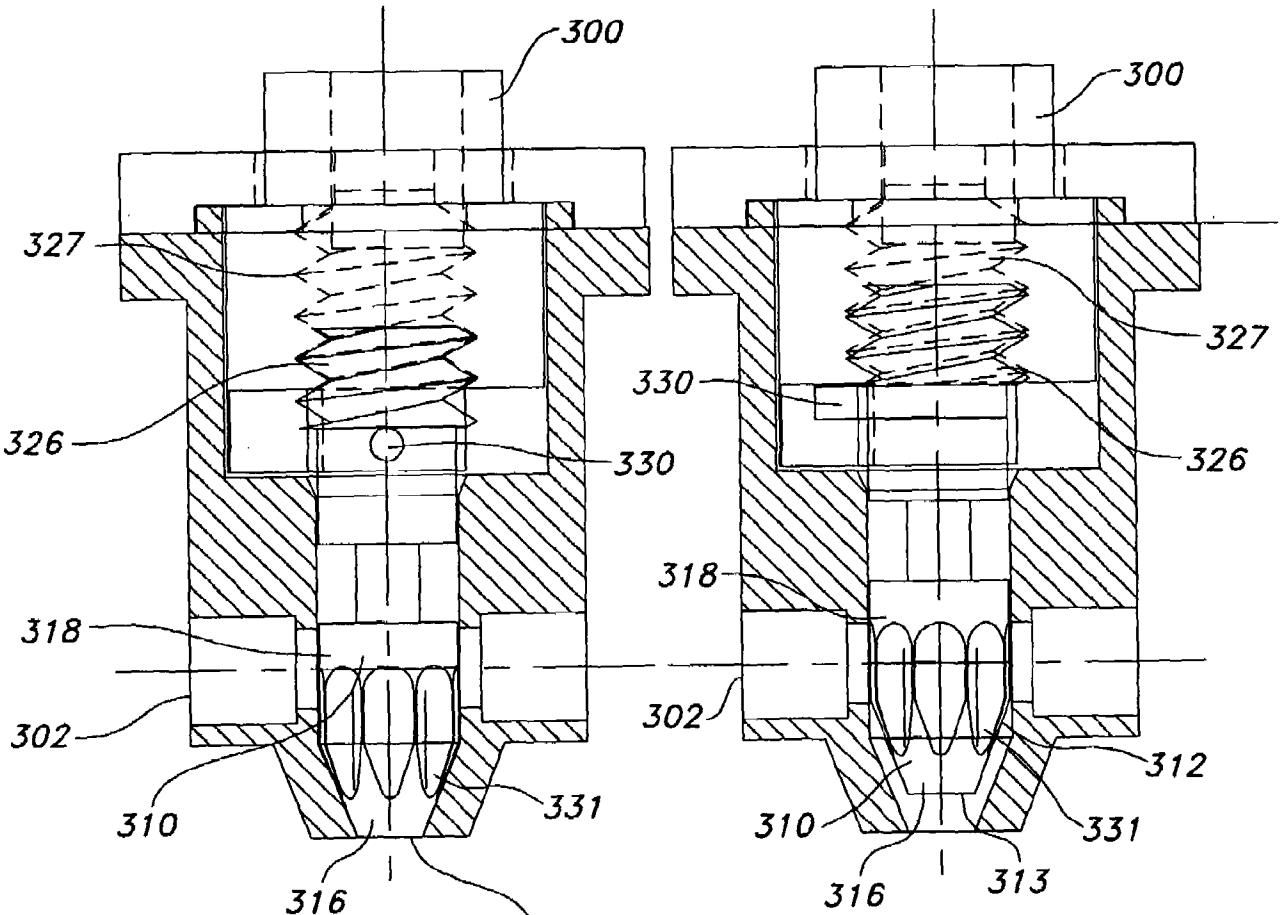
FIG. 21 is a cross sectional plan view of the alternative of FIG. 19.
FIG. 22 is a cross sectional plan view of the alternative of FIG. 19 in an open position.

Another embodiment of the dispensing system 18 is shown in FIGS. 17-22. In this embodiment, the spinning element 104 is a spinning cone 210 instead of a spinning disc. As with the spinning disc, the dispensing system 18 of this embodiment includes a motor 200, a plurality of inlets 202, nozzle 206, and a mixing head 207. The mixing head 207 includes an internal chamber 212, with an inner surface 214. The chamber 212 narrows as it approaches the nozzle 206. The cone 210 is disposed in the chamber 212, and includes a nose 216 having a surface 215 and a tip 213. The nose 216 fits inside the inner surface 217 of the nozzle 206. The cone 210 includes a base 218 that fits inside the inner surface 214 of the chamber 212 and defines a notch 220 for receiving an O-ring 222. The O-ring creates an airtight seal against the inner surface 214. The inlets 202 are holes similar to those of the previous dispensing system embodiment, except that the holes extend through the side wall 224 of the mixing head 207 and exit near the base 218 of the cone 210. The motor 200 may be attached to the mixing head 207, for instance with conventional fasteners 231 extending through mounting holes 221, 223 on the motor 200 and mixing head 207. The cone 210 may be coupled to the motor 200 by a conventional drive shaft 226 that extends into a bore 227 in the base 218 of the cone 210, so that the motor 200 can be actuated to spin the cone 210. In addition, the drive shaft 226 may include a hole 228 that receives a transverse rod 230, and the base 218 of the cone 210 may include a similar hole 232, also for receiving the transverse rod 230. The rod 230 may be movable within the hole when the motor 200 is actuated. This provides the cone 210 with selective movement between a closed position (shown in FIG. 25) wherein the cone 210 fits tightly within the nozzle 206 and seals the nozzle 206, and an open position (not shown) wherein the cone 210 is displaced away from the nozzle 206 forming a gap between the cone 210 and the inner surface 217 of the nozzle 206. The cone 210 may be biased in the closed position to seal the nozzle 206 by a spring 234 disposed about the drive shaft 226. An alternative embodiment of the cone 310 is shown in FIGS. 19-22. In this embodiment, the motor 300 is coupled to the cone 310 by a threaded rod 326. As the motor 300 is actuated, the rod 326 travels up a threaded shaft 327 to move the cone 310 from a closed position (FIGS. 19 and 21) to an open position (FIGS. 20 and 22). A transverse rod 330 may extend through a portion of the rod 326 to act as a stop, preventing the threaded rod 326 from traveling too far up the shaft 327. Also in this embodiment, the cone 310 may include a plurality of notches 331. The notches may be cut into a portion of the base 318 and a portion of the nose 316. In yet another alternative embodiment, the motor 300 may be coupled to the cone 310 or other spinning element such that the spinning element is manually movable to an open position, or in a variety of other configurations for sealing the nozzle.

Operation of this embodiment is similar to that of the spinning disc 110. As each of the liquid additives pass through one of the inlets 202, they enter the chamber 212 inside the mixing head 207 and are disposed on the surface 215 of the cone 210. As the liquid enters the chamber 212, the cone 210 (or 310) may move from a closed position to an open position, as described above. The motor 200 attached to the cone 210 is connected to the control system 22, and may either be running as the additives reach the cone 210, or may be signaled to start as the additives reach the cone 210. In either case, the cone 210 spins while the additives are on the surface 215 of the cone 210. This spinning motion causes all of the additives to blend together on the surface 215 of the cone 210. At the same time, the additives slide along the cone 210 towards the tip 213 of the cone 210, whereby the blended additives fall off the surface 215 of the cone 210 and into the container 20 positioned below the nozzle 206. The shape of the cone 210 directs the liquid additives towards the tip 231 and to control the flow of liquid into the container 20. In the alternative embodiment shown in FIGS. 31-34, the blending process is aided by the notches 331. As the liquid enters the chamber 312 through the inlets 302, small portions of each liquid are sliced off into separate notches 331 and the slices are then blended together as they travel out of the notches 331 and off the tip 313 of the cone 310. Any desired amount of liquid can be dispensed from the device 10 into the container 20, at which point the container 20 may be removed from the device 10 and may be sealed.

The above descriptions are those of current embodiments of the invention. Various alterations and changes can be made without departing from the spirit and broader aspects of the invention, which are to be interpreted in accordance with the principles of patent law including the Doctrine of Equivalents.

The invention claimed is:

1. A device for dispensing a liquid composition comprising:

at least one cartridge containing a plurality of liquid additives, said cartridge removably attached to the device;

a plurality of pumps, each of said pumps associated with one of said liquid additives for drawing said liquid additives from said cartridge;

a dispensing system including an inlet, a spinning element and an outlet, said inlet receiving said liquid additives and directing said liquid additives into contact with said spinning element, said spinning element capable of spinning to mix said liquid additives into a liquid composition, said outlet defining an exit for said liquid composition from the device, wherein said spinning element is a spinning cone, said spinning cone tapering to a tip that fits inside said outlet, and wherein said spinning cone is moveable between a closed position wherein said spinning element seals said outlet, to an open position wherein said spinning element is displaced away from said outlet to allow said blended liquid additives to exit the device.

2. The device of claim 1 wherein said spinning cone includes a base portion, and a nose portion tapering to said tip, at least one of said base portion and said nose portion defining a plurality of circumferentially spaced notches.

3. A device for dispensing a liquid composition comprising:

a plurality of liquid additives; and a mixing head, said mixing head defining a flow path for said liquid additives, said flow path including an inlet and an outlet, said mixing head including a spinning element disposed in said flow path between said inlet and said outlet, said inlet receiving said liquid additives and directing said liquid additives onto said spinning element, said spinning element capable of spinning about an axis to blend said liquid additives on said spinning element, said spinning element movable along said axis between a closed position wherein said spinning element seals said outlet, to an open position wherein said spinning element is displaced away from said outlet to allow said blended liquid additives to exit said mixing head through said outlet.

4. The device of claim 3 wherein said spinning element is biased in said closed position by a spring, said spinning element displaced to said open position by said liquid as said liquid flows toward said outlet.

5. The device of claim 3 including a threaded rod and a threaded shaft, wherein said spinning element is connected to said threaded rod, and wherein said threaded rod can be actuated to travel within said threaded shaft to move said spinning element between said open and closed positions.

6. The device of claim 3 wherein said mixing head defines an internal chamber, and wherein said spinning element is a spinning cone disposed within said internal chamber, said cone including a base and a nose that tapers to a tip, said inlet directing said liquid additives onto said nose such that the liquid additives flow toward said tip.

7. The device of claim 6 wherein said tip fits within said outlet to seal said outlet in said closed position.

8. A device for dispensing a liquid composition comprising:

a housing;

a pumping system in said housing, said pumping system including a plurality of pumps;

a plurality of cartridges removably attached to said pumping system, said cartridges each containing a liquid additive, each of said cartridges associated with one of said pumps, said pumps being actuated to draw said liquid additives from said cartridges;

a dispensing system in said housing, said dispensing system including an inlet connected to said pumping system, a spinning element, and an outlet, said inlet receiving said liquid additives and directing said liquid additives onto a surface of said spinning element, said spinning element capable of spinning to blend said liquid additives on said surface, said spinning element shaped to direct said liquid additives toward said outlet, said outlet defining an exit from said housing; and a compact container, said container supported by said housing and positioned to receive said liquid additives from said outlet, wherein each cartridge includes an internal piston forming an airtight seal inside said cartridge, an air hole, and an exit orifice, said piston drawn toward said exit orifice as said liquid additive is drawn out of said cartridge.

* * * * *